US012704069B2

(12) United States Patent
Schevets

(10) Patent No.: US 12,704,069 B2
(45) Date of Patent: Aug. 11, 2026

(54) SLIDING VANE PUMP OR TURBINE HAVING TRACK FOLLOWERS

(71) Applicant: Amorphic Tech Ltd., Allentown, PA (US)

(72) Inventor: Andrew Schevets, Emmaus, PA (US)

(73) Assignee: Amorphic Tech Ltd., Allentown, PA (US)

( * ) Notice: Subject to any disclaimer, the term of this patent is extended or adjusted under 35 U.S.C. 154(b) by 0 days.

(21) Appl. No.: 18/336,527

(22) Filed: Jun. 16, 2023

(65) Prior Publication Data

US 2023/0407748 A1 Dec. 21, 2023

Related U.S. Application Data

(60) Provisional application No. 63/366,559, filed on Jun. 17, 2022.

(51) Int. Cl.
*F01C 21/08* (2006.01)
*F01C 1/356* (2006.01)
(Continued)

(52) U.S. Cl.
CPC ..... *F01C 21/0818* (2013.01); *F01C 21/0809* (2013.01); *F04C 15/0057* (2013.01);
(Continued)

(58) Field of Classification Search
CPC ..... F04C 2/3446; F04C 15/0057; F04C 2240/20; F04C 2240/30; F01C 21/0836;
(Continued)

(56) References Cited

U.S. PATENT DOCUMENTS 158,664 A 1/1875 Adams
3,160,147 A 12/1964 Hanson
(Continued)

FOREIGN PATENT DOCUMENTS

EP 0890721 9/1997
EP 2224095 1/2010
(Continued)

OTHER PUBLICATIONS

International Search Report and Written Opinion from corresponding Patent Cooperation Treaty (PCT) Application No. PCT/IB2023/056284, completed Aug. 12, 2023, mailed Sep. 7, 2023.
(Continued)

*Primary Examiner* — Deming Wan
*Assistant Examiner* — Paul W Thiede
(74) *Attorney, Agent, or Firm* — Gardner, Linn, Burkhart & Ondersma LLP

(57) ABSTRACT

A positive-displacement pump or turbine includes a rotor casing that defines a rotor chamber having a contoured wall that forms a plurality of lobes. A rotor is positioned within the rotor chamber, and has an outer rotor surface spaced inward from the contoured wall at the lobes. Vanes are mounted around the outer rotor surface, and structures associated with the vanes follow a track or groove defined by the rotor chamber as the rotor spins, thereby forcing the vanes radially inwardly and outwardly to follow a curvature of the contoured wall.

16 Claims, 5 Drawing Sheets

(51) Int. Cl.
*F04C 2/344* (2006.01)
*F04C 15/00* (2006.01)

(52) U.S. Cl.
CPC ..... *F01C 1/3566* (2013.01); *F04C 2/3446* (2013.01); *F04C 2240/20* (2013.01); *F04C 2240/30* (2013.01)

(58) Field of Classification Search
CPC .... F01C 21/108; F01C 1/3446; F01C 1/3447; F01C 1/356
USPC ..... 418/79–82
See application file for complete search history.

(56) References Cited

U.S. PATENT DOCUMENTS 3,568,645 A * 3/1971 Grimm ..... F01C 1/3446 418/264
3,686,893 A 8/1972 Edwards
3,904,327 A * 9/1975 Edwards ..... F01C 1/3446 418/8
3,905,204 A 9/1975 Edwards
4,088,426 A 5/1978 Edwards
4,183,352 A 1/1980 Spencer
4,335,965 A 6/1982 Faverty et al.
4,410,305 A 10/1983 Shank et al.
4,507,067 A 3/1985 Hansen
4,799,867 A * 1/1989 Sakamaki ..... F01C 21/0836 418/152
5,819,554 A 10/1998 Glen
6,070,409 A * 6/2000 Kaiser ..... F01C 21/0836 60/512
6,589,033 B1 7/2003 Johnson et al.
7,040,872 B2 * 5/2006 Endoh ..... F01C 1/3446 92/72
7,140,853 B2 11/2006 Al Hawaj
8,336,518 B2 * 12/2012 Sleiman ..... F02B 53/02 123/243
8,424,284 B2 4/2013 Staffend et al.
9,435,354 B2 9/2016 Lehner et al.
9,708,924 B2 7/2017 Al-Hawaj
9,759,066 B2 9/2017 Schevets
2009/0087334 A1 4/2009 Whitesell
2015/0300174 A1 * 10/2015 Schevets ..... F04C 15/062 418/15
2017/0198695 A1 7/2017 Heaps et al.
2022/0003235 A1 * 1/2022 Seol ..... F04C 23/008

FOREIGN PATENT DOCUMENTS

WO 2009073406 6/2009
WO 2012010397 A2 1/2012

OTHER PUBLICATIONS

European Search Report for EP Application No. 23823389.4 dated Apr. 9, 2026.
European Extended Examination Report for EP Application No. 23823389.4 dated Apr. 24, 2026.

* cited by examiner 10
10a
48
48
48
30
30a
28
28
28
28
28a
28b
28b
28a
28b
28b
44
44
44
44
58
58
58

101

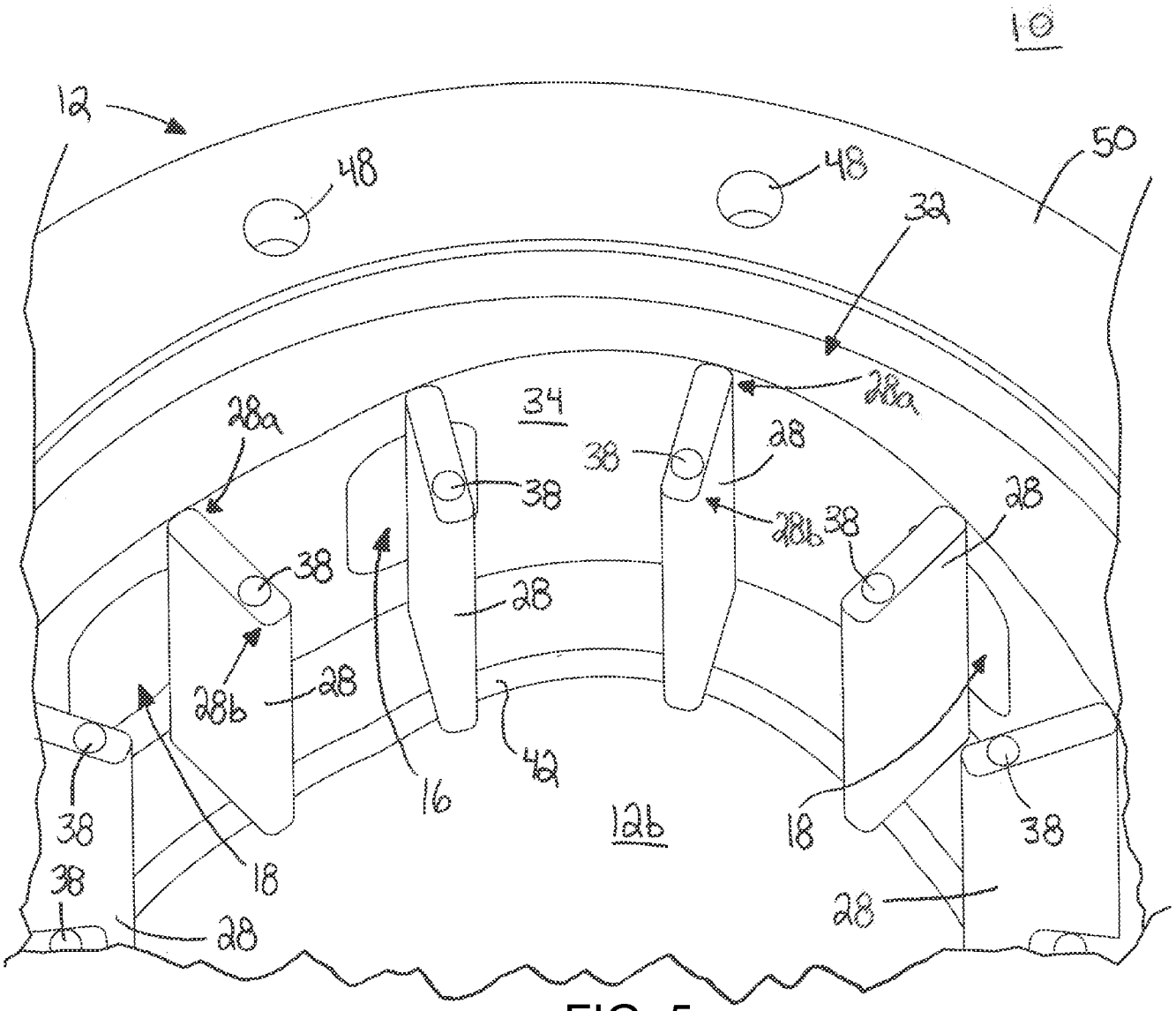
10
50
48
48
34
38
28
28a
28b
28
38
38
38

SLIDING VANE PUMP OR TURBINE HAVING TRACK FOLLOWERS

CROSS-REFERENCED RELATED APPLICATIONS

The present application claims the benefit of U.S. provisional application Ser. No. 63/366,559, filed Jun. 17, 2022, which is hereby incorporated by reference in its entirety.

GOVERNMENT LICENSE RIGHTS

This invention was made with government support under DE-SC0020193 awarded by the U.S. Department of Energy. The government has certain rights in the invention.

FIELD OF THE INVENTION

The present invention relates to positive-displacement turbines and pumps and, more particularly, to turbines and pumps having a power-driven or fluid-driven rotor mounted in a rotor casing or stator.

BACKGROUND OF THE INVENTION

Sliding-vane pumps and turbines are a positive-displacement type of prime mover technology that functions in part by changing the volume of an internal chamber of the pump or turbine. The change in chamber volume is accomplished by a sliding vane mounted to a rotor and following a cam-style surface of a rotor casing, which changes the chamber volume as the rotor spins and the sliding vane or vanes are driven along the cam-style surface. The vane may slide, for example, through utilizing springs that exert a spring force on the vane, hydraulic balancing with cross-drilled holes in a rotor or in vanes, or simply due to a centrifugal force resulting from the rotation of the vanes. Such turbine devices may be used in hydraulics, cryogenics, industrial fluid transfer, and the like.

SUMMARY OF THE INVENTION

The present invention provides an energy exchanging pump and turbine device capable of transferring energy from one fluid to another fluid, where the fluids may be liquids, gases, or combinations thereof. The device utilizes a pump and turbine rotor mounted in a rotor casing having a contoured or cam-like wall that cooperates with the rotor to form a plurality of lobes. One or more vanes are mounted to the rotor, and are slidable inwardly and outwardly in a radial direction. Each of the one or more vanes defines at least one dimple or depression that is aligned with a track or groove affixed to or defined by the rotor chamber. One or more balls are retained between the dimples and the groove, and roll and/or slide within the groove as the rotor rotates the vanes. The curvature of the groove follows the curvature of the contoured wall such that the groove forces the balls—and by extension the vanes—to move inwardly and outwardly in the radial direction as the rotor and vanes rotate such that outer tips of the vanes maintain sliding contact with the contoured wall as the rotor spins. This arrangement positively and/or mechanically forces the vanes into defined radial extension distances as the rotor spins to reduce fluid leakage at each vane/contour wall barrier and improve the overall efficiency and reliability of the pump and turbine device.

According to one form of the present invention, a positive-displacement pump and turbine includes a rotor casing defining a rotor chamber having a contoured wall that forms a plurality of lobes, and a sidewall defining a curved track spaced radially inwardly from the contoured wall. A rotor positioned in the rotor chamber includes an outer rotor surface spaced inwardly from the contoured wall at the lobes. A number of vanes are mounted at the rotor and are spaced circumferentially around the outer rotor surface. The vanes include distal end portions that slidably engage the contoured wall, and track followers that engage the curved track. The vanes are forced radially inwardly and outwardly relative to the rotor by engagement between the track followers and the curved track during rotation of the rotor and the vanes.

In one aspect, the curved track maintains a uniform distance to the contoured wall around the rotor chamber.

In another aspect, the curved track includes a groove formed in the sidewall of the rotor casing, and the track followers include projections extending from side edges of the vanes and into the groove.

In yet another aspect, the side edges of the vanes define recessed dimples and the projections include balls captured between the groove and respective recessed dimples.

In still another aspect, the groove includes a semi-circular cross-sectional shape and the recessed dimples include semi-spherical shapes.

In a further aspect, the balls are spherical and slide or roll along the groove so that the recessed dimples maintain alignment with the groove during rotation of the rotor and the vanes. Optionally, about one-half of each of said balls is contained within one of said dimples and the other half is contained in said groove.

In yet a further aspect, the rotor casing includes an opposite sidewall defining an opposite track, and each of the vanes include a pair of the track followers arranged at respective opposite sides of the vanes, in which the track followers engage respective tracks.

In still a further aspect, the tracks are identically-shaped and aligned with one another at opposite sides of the rotor chamber.

In one aspect, adjacent portions of the groove and the contoured wall are equally-spaced across the entirety of the groove.

In another aspect, the lobes include a first lobe located across from a second lobe, and a third lobe located across from a fourth lobe.

In yet another aspect, the vanes include have opposing side surfaces that define the dimples, and the rotor chamber includes an opposing side surfaces that define respective grooves for capturing balls between each side of each vane and a respective sidewall of the rotor chamber. Optionally, the grooves are identically-shaped and aligned with one another.

In still another aspect, the groove has a semi-circular shape defined by the rotor chamber.

In a further aspect, the dimples are semi-spherical depressions that remain aligned with the groove while the vanes are rotated. Optionally, each of the balls is spherical, where approximately half of each spherical ball is contained within a respective one of the dimples.

According to another form of the present invention, a positive-displacement pump and turbine includes a rotor casing that forms a rotor chamber having a contoured wall and spaced-apart side surfaces defining respective contoured grooves that are spaced inwardly from the contoured wall. A vane is movably mounted to a rotor, and is guided by a locator assembly that causes the vane to follow the grooves as the rotor and vane spin together. The rotor may be rotatably drivable by a fluid, or by a rotational force applied to a rotor shaft coupled to the rotor.

In one aspect, the locator assembly includes dimples formed along opposing sides of the vane, and balls captured between the dimples and the respective grooves. Optionally, the side surfaces of the rotor casing cooperate with opposite edges of the vane to form substantially fluid-tight barriers, and a distal edge of the vane forms a substantially fluid-tight barrier with the contoured wall.

In another aspect, the locator assembly urges a distal end portion of the vane into continuous sliding contact with the contoured wall while the rotor is rotating.

In a further aspect, the contoured wall forms exactly four lobes of the rotor chamber, in which the rotor includes an outer rotor surface that is spaced inwardly from the contoured wall. An inlet port and an outlet port are defined in the contoured wall at each of the lobes. Additionally, the positive-displacement pump and turbine includes exactly thirteen of the vanes that are evenly-spaced along the outer rotor surface. Optionally, the vanes are each independently moveable inwardly and outwardly in a radial direction as the rotor is rotatably driven in the rotor chamber. The vanes may also be substantially rigid and have a generally rectangular shape.

According to a method of the present invention, a positive-displacement pump and turbine may be operated by: rotatably driving a pump or turbine rotor located within a rotor chamber, where the rotor includes a number of vanes mounted at an outer surface thereof, and the vanes having track followers; and urging the vanes radially inwardly and outwardly via engagement of the track followers with a curved track formed in a sidewall of the rotor chamber to maintain distal end portions of the vanes in sliding engagement with a contoured wall of the rotor chamber.

In one aspect, urging the vanes inwardly and outwardly in a radial direction includes driving a ball associated with each of the vanes along a groove that forms the curved track. Optionally, the groove is spaced a fixed distance from the contoured wall.

Thus, the pump and turbine of the present invention provides an energy efficient exchanger that mechanically locates one or more vanes in defined positions to ensure the vanes remain in sliding contact within an inner contoured wall of a rotor chamber, even at lower rotational speeds. A rotor is fitted with vanes that can move radially to remain in contact with the contoured wall of the rotor chamber. A track following element or ball is captured between each vane and a corresponding groove in a sidewall of the rotor chamber to control the radial movement of the vane and ensure the outer or distal end of the vane remains in contact with the contoured wall during rotation, thus reducing fluid leakage between the vane and contoured wall, including during lower speed operation.

These and other objects, advantages, purposes and features of the present invention will become apparent upon review of the following specification in conjunction with the drawings.

BRIEF DESCRIPTION OF THE DRAWINGS

FIG. 5 is an enlarged view of a portion of the sliding vane pump or turbine of FIG. 4.

DESCRIPTION OF THE PREFERRED EMBODIMENTS

Figure 1:
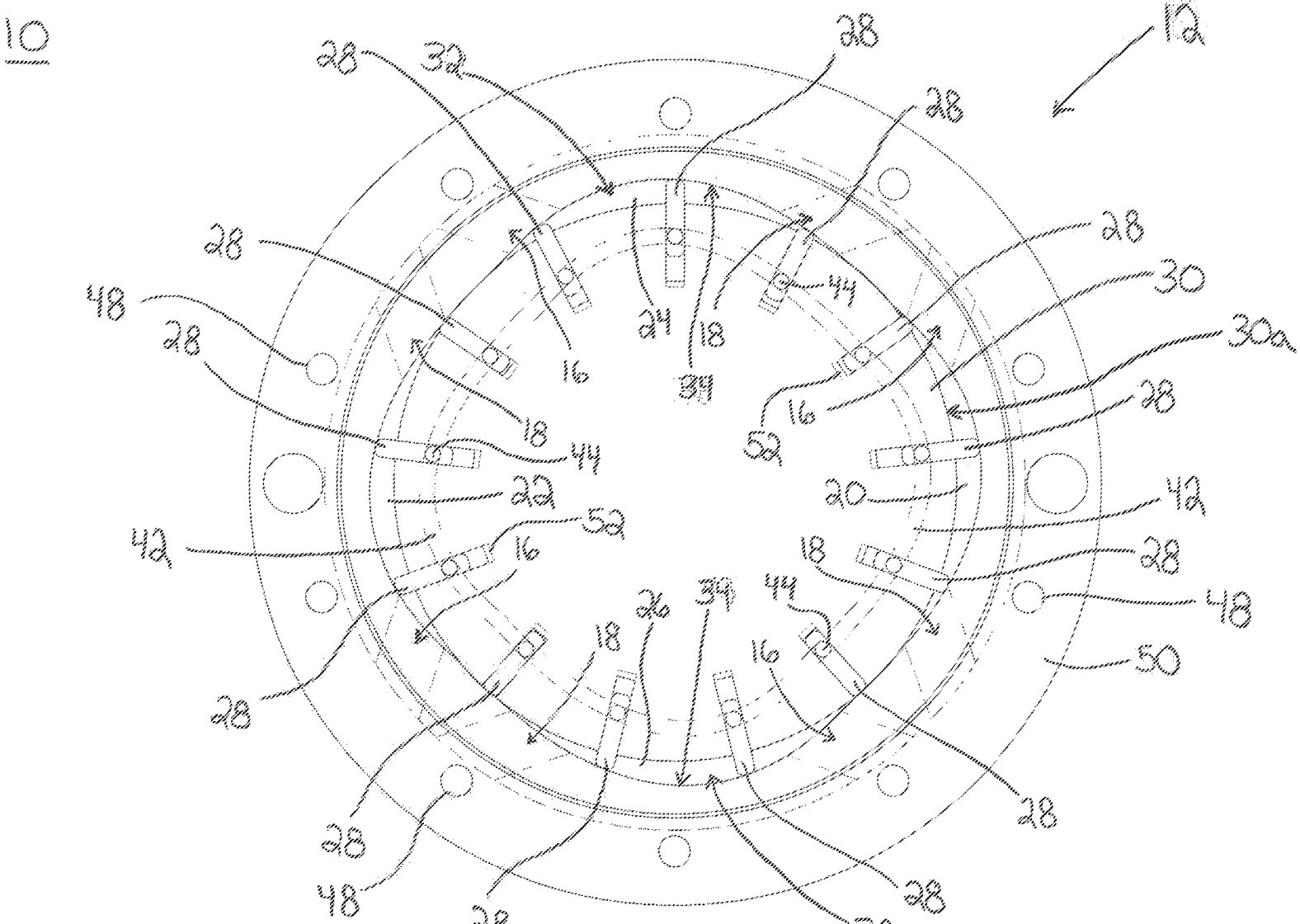
FIG. 1 is a front elevation view of a sliding vane pump or turbine in accordance with the present invention, in which a grooved track, a housing cap, and fluid inlets and outlets are represented by dashed lines.
Figure 3:
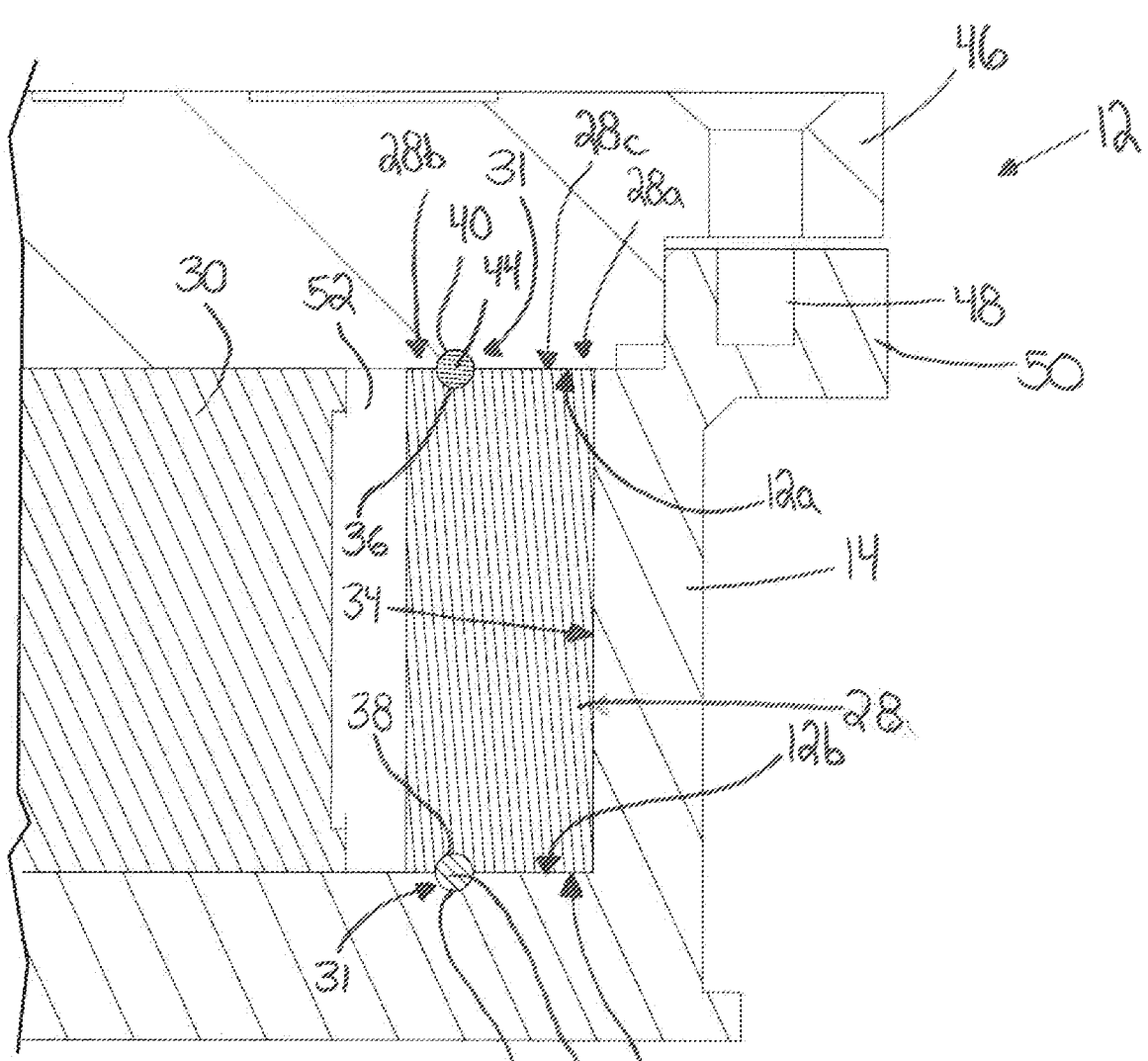
FIG. 3 is a side sectional elevation view taken along section line III-III in FIG. 2.

Referring now to the drawings and the illustrative embodiment depicted therein, a positive-displacement single-rotor pump and/or turbine 10 is configured for use as a fluid energy exchanger, or optionally as a fluid pump. Pump and turbine 10 includes a pump or turbine body 12, which may be formed as a unitary casting, and has a stator or rotor casing 14 (FIG. 1). Rotor casing 14 defines a series of inlet ports 16 and outlet ports 18 at four lobes 20, 22, 24, 26 for exchanging fluid between turbine 10 and one or more external devices, assemblies, or the external environment. A series of slidable vanes 28 are mounted at an outer surface 30*a* of a rotor located within a rotor chamber 32 of rotor casing 14. A plurality of radial locators or locator assemblies 31 include track followers in the form of balls 44 that are retained by dimples defined by vanes 28. In the illustrated embodiment, the dimples are semi-spherically-shaped depressions in the form of first side dimple 36 and a second side dimple 38 (FIG. 3). Rotor chamber 32 is formed by contoured wall 34 and a pair of side surfaces 12*a*, 12*b* on opposite sides thereof. Side surfaces 12*a*, 12*b* define respective contoured tracks, illustrated as channels or grooves 40, 42 forming respective continuous loops. First side dimple 36 and groove 40, and second side dimple 38 and groove 42 cooperate to retain balls 44 within dimples 36, 38 and grooves 40, 42. Rotor 30 may be driven to rotate in the manner of a turbine, by directing a fluid into the rotor chamber 32 via the one or more inlets 16. The rotation of rotor 30 and vanes 28 causes balls 44 to roll or slide along grooves 40, 42. Grooves 40, 42 are shaped as continuous loops with curved paths so that balls 44—and by extension vanes 28—are forced inwardly and outwardly in a radial direction as rotor 30 rotates, to ensure distal end portions 28*a* of vanes 28 remain in sliding contact with contoured wall 34. Thus, during operation of turbine 10, vanes 28 are rotated by rotor 30 and simultaneously urged into optimized radial positions via locator assemblies 31 and grooves 40, 42 to improve the overall efficiency of turbine 10 by reducing leakage between distal end portions 28*a* and contoured wall 34.

Figure 2:
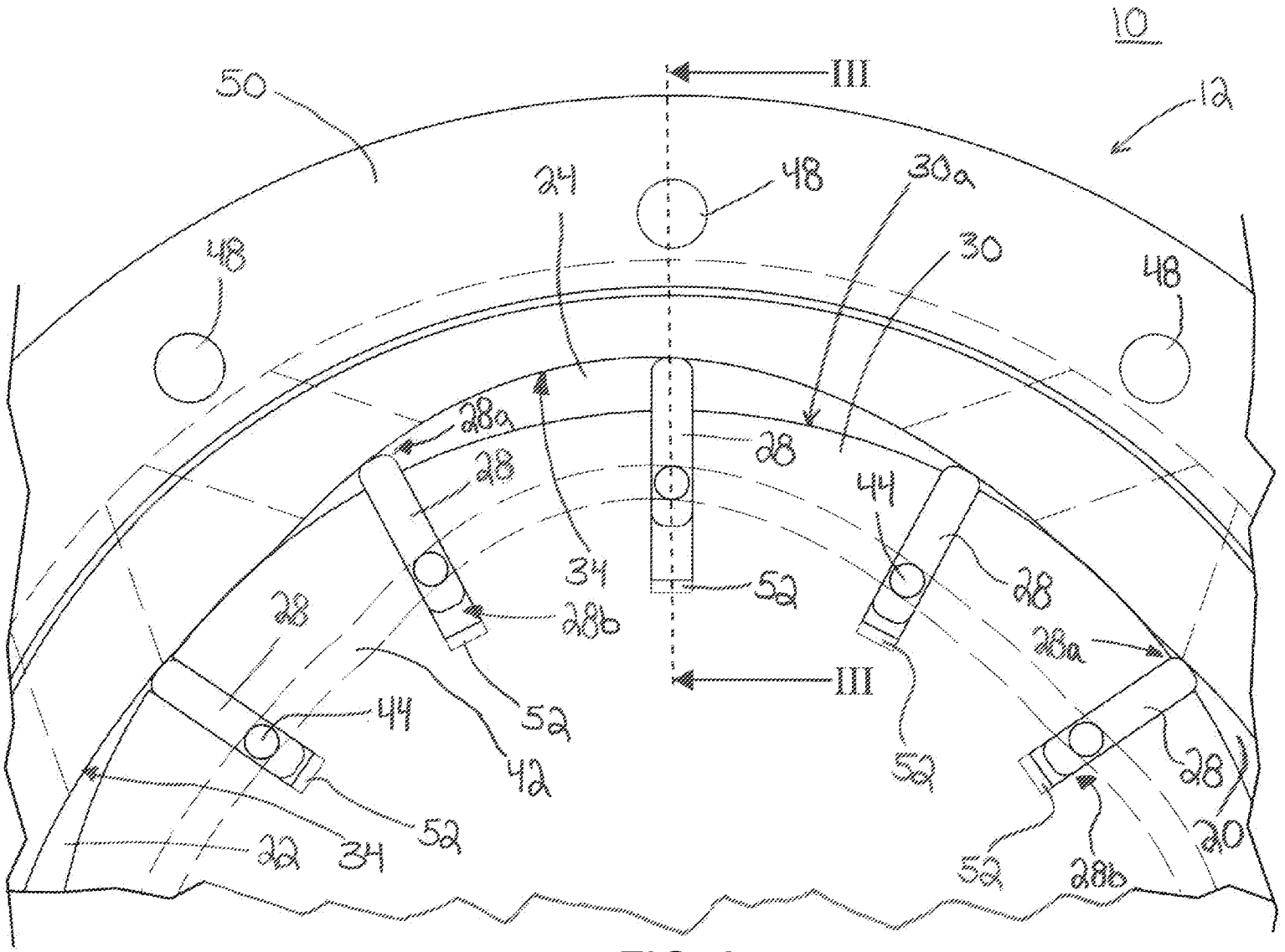
FIG. 2 is an enlarged view of the sliding vane pump or turbine of FIG. 1.

Rotor 30 fits into rotor chamber 32 such that outer rotor surface 30*a* is spaced inwardly from contoured wall 34 at least at lobes 20, 22, 24, 26 as shown in FIGS. 1 and 2. A cap or bearing cover 46 encloses rotor chamber 32, and is held in place with a plurality of threaded fasteners that are received in respective threaded bores 48 formed in an outer rim 50 of rotor casing 14 (FIG. 3). An O-ring gasket may be seated between bearing cover 46 and outer rim 50 to seal off rotor chamber 32 from the outside environment. Once secured to rotor casing 14, bearing cover 46 forms first side surface 12*a* of rotor chamber 32. First side surface 12*a* defines first pathway or groove 40, which is vertically-aligned (as viewed from FIG. 3) with second side pathway or groove 42 that is defined by second side surface 12*b* of rotor chamber 32. Both grooves 40, 42 are rounded spherical grooves having semi-circular cross sections, and have identical curvatures to maintain an equal or uniform inward spacing from contoured wall 34. That is, the curvature of grooves 40, 42 follow the curvature of contoured wall 34 such that the spacing of grooves 40, 42 and contoured wall 34 is uniform. Grooves 40, 42 form continuous loops or enclosed paths such that there is no end point or termination point along their lengths.

The rotor's outer surface 30*a* is generally cylindrical, with a plurality of radially-aligned slots 52 extending inwardly for receiving respective sliding vanes 28 that engage cam-like contoured wall 34 as rotor 30 spins within rotor chamber 32 (FIGS. 1 and 2). In the illustrated embodiment, and as shown in FIGS. 1 and 2, slots 52 are blind slots that terminate in a body of the rotor. Vanes 28 each include a proximal edge portion 28*b* that is received in a respective slot 52 of rotor 30, and that is located opposite a respective distal edge portion 28*a*. As shown in FIG. 3, vanes 28 further include a first side surface 28*c* that is located adjacent to first side surface 12*a* of rotor chamber 32, and a second side surface 28*d* that is located opposite first side surface 28*c* and adjacent to second side surface 12*b* of rotor chamber 32. Side surfaces 28*c*, 28*d* are located near enough to the rotor chamber's side surfaces 12*a*, 12*b* so as to create a substantially fluid-tight barrier. The vane's first side surface 28*c* defines a rounded or spherical depression in the form of first side dimple 36, while the vane's second side surface 28*d* defines the similarly-shaped second dimple 38. Dimples 36, 38 are aligned with respective grooves 40, 42 to form rounded and semi-spherical cavities in which balls 44 are retained but remain free to roll or slide along grooves 40, 42. In the illustrated embodiment, each ball 44 is spherical in shape, with approximately half of each ball's spherical volume located within one dimple 36 or 38, and the other approximate half of the ball's spherical volume is located in groove 40 or 42. In the illustrated embodiment, and as shown in FIG. 3, the diameter of each ball 44 does not exceed a thickness of the respective vane 28 where ball 44 is mounted in one of the dimples 36, 38.

Figure 4:
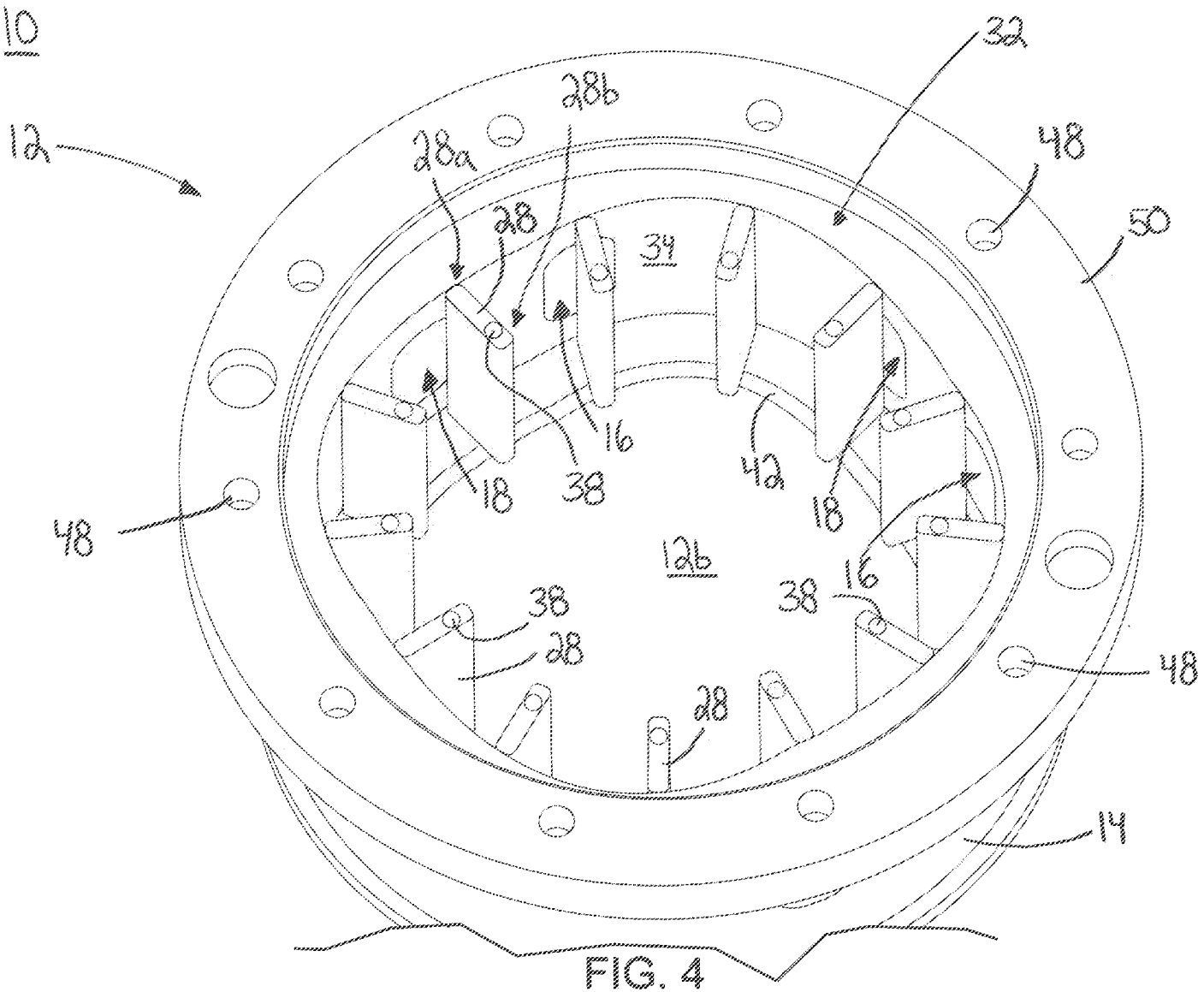
FIG. 4 is a perspective view of the sliding vane pump or turbine of FIG. 1, shown without a housing cap and a rotor.

Referring to FIGS. 4 and 5, during operation of turbine 10, the rotation of rotor 30 and vanes 28 within rotor chamber 32 causes the thirteen evenly-spaced vanes 28 to move radially inwardly and outwardly in slots 52 of rotor 30. As previously noted, balls 44 are retained within the semi-spherical cavities formed by first dimple 36 and first groove 40, and second dimple 38 and second groove 42. Thus, rotational motion of vanes 28 forces balls 44 to travel through or roll along grooves 40, 42. While balls 44 are traveling through curved grooves 40, 42, the 7 surfaces of grooves 40, 42 engage with balls 44 to moves balls 44 inwardly and outwardly in a radial direction. This radial movement of balls 44 is transferred to vanes 28 to cause radial movement of vanes 28. As a result, the radial position of both balls 44 and vanes 28 at any given point of the rotation is dependent on the shape or curvature of grooves 40, 42. Accordingly, locator assemblies 31, which include balls 44 and dimples 36, 38, engage with grooves 40, 42 to direct inward and outward radial motion of vanes 28 in response to the rotational motion of rotor 30.

To maintain desired contact between distal end portions 28*a* and contoured wall 34, grooves 40, 42 are evenly-spaced radially inward from contoured wall 34 along their lengths so as to mimic or follow the curvature of contoured wall 34. Furthermore, as described above, vanes 28 are forced to follow optimal radial positions due to the pre-defined curvature or geometry of grooves 40, 42. This minimizes fluid leakage between vanes 28 and contoured wall 34 during rotation. Grooves 40, 42 and balls 44 cooperate to draw vanes 28 radially inwardly as the vanes 28 trace the decreasing-volume portion of each lobe, which can reduce wear on both the contoured wall 34 and the distal ends 28*a* of the vanes 28 because the sliding contact of the vanes 28 with the wall 34 is not the only force pushing the vanes radially inwardly. It will be appreciated that even if balls 44, dimples 36, 38, and grooves 40, 42 were omitted, other factors would influence the radial position of vanes 28, namely, centrifugal force (once sufficient rotor speed is attained to overcome any frictional retention forces of vanes 28 in slots 52) and contact between distal end portions 28*a* and contoured wall 34. Such arrangements are more fully described in commonly-owned U.S. Pat. No. 9,759,066 entitled "UNITARY PUMP AND TURBINE ENERGY EXCHANGER," which is hereby incorporated herein by reference in its entirety.

Dimples 36, 38 and grooves 40, 42 may be created or formed through various processes, including, for example, machining dimples 36, 38 into side surfaces 28*c*, 28*d* of vanes 28, and machining grooves 40, 42 into first and second side surfaces 12*a*, 12*b* of rotor chamber 32. Alternatively, one or more of these features could be formed as a result of a molding process. Additionally, it should be appreciated that alternative turbines may include differences from the turbine 10 described above, in which case various features such as grooves and/or dimples may need to be formed with geometry that varies from what has been described herein. For example, the curvature of a groove may be varied from the curvature of the contoured wall, such as to open a gap between the distal ends of the vanes and the contoured wall along certain regions of the contoured well. It should also be appreciated that an alternative turbine may include more or less vanes, grooves, dimples, and/or balls apart from what has been described herein. Additionally, an alternative embodiment may include projections formed along the side edges of the vanes, instead of balls that roll or slide relative to the vanes 28 and the rotor casing 14. Additionally, other rotatable and/or slidable elements could be used as an alternative to balls, including wheels or the like. It is further envisioned that a continuous curved track, extending into the rotor chamber from the sidewalls of the rotor casing 14, may be received by recesses formed in the side edge of each vane.

As best shown in FIG. 1, rotor chamber 32 has four lobes including first lobe 20 located generally at the three o'clock position as viewed in FIG. 1, second lobe 22 located at the nine o'clock position across from first lobe 20, third lobe 24 located generally at the twelve o'clock position, and fourth lobe 26 located generally at the six o'clock position opposite third lobe 24. Respective fluid inlets 16 and fluid outlets 18 are defined in contoured wall 34 at each lobe, with each fluid inlet 16 and each fluid outlet 18 being in fluid communication with an external device or environment, such as via a fluid conduit. Such arrangements are more fully described in commonly-owned U.S. Pat. No. 9,759,066, which is hereby incorporated hereinabove by reference. Substantially equal fluid pressures occur in the respective lobes 20, 22 and 24, 26 that are located directly across from one another due to the alignment described above of lobes 20, 22, 24, 26, inlets 16, and outlets 18. Thus, during normal operation of rotor 30, the rotor experiences little or mechanically negligible net radial force, which reduces wear and facilitates the efficient and low-maintenance operation of the pump or turbine.

Turbine body 12, including rotor casing 14 that may be unitarily formed as a one-piece unit, such as via a casting process utilizing ferrous or non-ferrous alloy, such as steel or aluminum alloys. However, it is further envisioned that non-metals may be used, such as thermoplastics, fiber-reinforced thermoplastics, thermoset plastics, and fiber-reinforced thermoset plastics. It is further envisioned that the rotor casing may be made from plastics or relatively weaker materials, with a hardened insert (such as a metal liner) used to form contoured wall 34, which may be integrated with outer rim 50 to form wear-resistant and strong bores 48. Optionally, pump or turbine body 12 may include one or more base brackets and/or an upper bracket to facilitate mounting turbine 10 in a desired location within a system.

Although the unitary pump and turbine energy exchanger of the illustrated embodiment has exactly four lobes 20, 22, 24, 26 and exactly thirteen vanes 28 that are evenly spaced circumferentially around rotor 30, it will be appreciated that a pump and turbine energy exchanger may be configured with different numbers of lobes and different number of vanes, without departing from the spirit and scope of the present invention. For example, substantially any even number of lobes, four or greater, may achieve substantially the same balanced-force effect as the four-lobe embodiment that is primarily described herein. In the case of a six-lobe variant, for example, a lobe would be positioned every 60-degrees around a rotor chamber. Furthermore, in the illustrated embodiment, vanes 28 are generally rectangular in shape and are made of a substantially rigid material, such as metal or reinforced plastic. However, it is envisioned that flexible vanes may be suitable for some applications.

It should be appreciated that a track follower adapted to movably or slidably couple or locate a side surface of a vane relative to a surface of a contoured wall may take alternative forms apart from a ball while remaining within the spirit and scope of the present invention. A track follower could be a groove, recess, or recessed coupling feature defined at or coupled to a vane, in which the track follower receives or engages a curved track to follow the curved track defined at or coupled to a side surface and/or contoured wall of a rotor chamber. The curved track in this case may take many forms including that of a protrusion or raised feature relative to the side surface and/or the contoured wall, an elongated ridge, or a continuous track structure that is raised or protruding outwardly from the side surface and/or contoured wall. Alternatively, a track follower could be a protrusion or coupling feature defined at or coupled to a vane, in which the track follower is received by a curved track that could take various forms, including for example, a groove or recess defined at a side surface and/or a contoured wall of a rotor chamber, an elongated recess or channel, or a track or pathway that is recessed beneath or outboard of the side surface and/or the contoured wall.

Accordingly, the pump and turbine system and methods of operation of the present invention, as a turbine or pump, or simultaneously as a turbine and pump, reduces internal fluid leakage at a series of vanes to operate with increased efficiency and reliability by positively locating the vanes to ensure proper engagement between the vanes and a contoured wall within a rotor chamber. The rotor may be driven to rotate, for example, by one or more fluids entering and exiting the rotor chamber at different lobes, to thereby rotate the vanes and rotor by applying elevated fluid pressure to one side of the vanes. Optionally, the rotor may be externally driven by a motor or other power source, which may be coupled to a rotor shaft. Regardless of the driving force for the rotor and vanes, rotation of the vanes moves the balls through the grooves, with the balls following the radially inward and outward contours of the grooves to thereby move the vanes radially inward and outward to maintain desired engagement between the vanes and the contoured wall.

Changes and modifications in the specifically-described embodiments may be carried out without departing from the principles of the present invention, which is intended to be limited only by the scope of the appended claims as interpreted according to the principles of patent law including the doctrine of equivalents.

The embodiments of the invention in which an exclusive property or privilege is claimed are defined as follows:

1. A positive-displacement pump or turbine comprising:

a rotor casing defining a rotor chamber having a contoured wall forming a plurality of lobes around a central axis, and a pair of sidewalls defining respective curved tracks spaced radially inwardly from said contoured wall, said curved tracks each comprising a groove formed in a respective one of said sidewalls;

a rotor positioned in said rotor chamber and having a rotational axis at said central axis, said rotor having a cylindrical outer rotor surface spaced inwardly from said contoured wall at said lobes, said rotor defining a plurality of blind slots open at said outer rotor surface and each having a continuous slot width extending from proximate said outer rotor surface to proximate a blind inboard end;

a plurality of vanes mounted at said rotor and spaced circumferentially around said outer rotor surface, said vanes comprising (i) distal ends configured to slidably engage said contoured wall along the width of said contoured wall including said plurality of lobes, (ii) proximal ends received in respective ones of said blind slots in said rotor, and (iii) recessed dimples formed in opposite side edges of said vanes, said recessed dimples spaced between said distal and proximal ends of said vanes; and track followers engaging said curved tracks, said track followers comprising balls captured between said grooves and respective ones of said recessed dimples;

wherein each of said balls has a diameter not exceeding a thickness of a respective one of said vanes at said recessed dimple;

wherein said vanes are forced radially inwardly and outwardly relative to said rotor by engagement of said track followers with said curved tracks during rotation of said rotor and said vanes; and wherein said curved tracks are spaced a uniform distance from said contoured wall including said plurality of lobes around said rotor chamber.

2. The pump or turbine of claim 1, wherein said grooves each comprise a semi-circular cross-sectional shape and said recessed dimples comprise semi-spherical shapes.

3. The pump or turbine of claim 2, wherein said balls are spherical and slide or roll along said groove so that said recessed dimples maintain alignment with said groove during rotation of said rotor and said vanes.

4. The pump or turbine of claim 3, wherein about one-half of each of said balls is contained within one of said dimples and the other half is contained in said groove.

5. The pump or turbine of claim 1, wherein said rotor casing comprises an opposite sidewall defining an opposite track, and each of said vanes comprises a pair of said track followers arranged at respective opposite sides of said vanes, wherein said track followers engage respective ones of said tracks.

6. The pump or turbine of claim 5, wherein said tracks are identically-shaped and aligned with one another at opposite sides of said rotor chamber.

7. A pump or turbine comprising:

a rotor casing comprising a contoured wall including a lobe, and spaced-apart side surfaces defining respective continuous grooves that are spaced inwardly from said contoured wall, said contoured wall cooperating with said side surfaces to define a non-circular rotor chamber having a central axis;

a rotor positioned in said rotor chamber and having a rotational axis at said central axis, said rotor defining a plurality of blind slots open at a cylindrical outer rotor surface, each of said blind slots having a continuous slot width extending from proximate said outer rotor surface to proximate a blind inboard end; and a plurality of vanes at respective ones of said blind slots of said rotor, each of said vanes comprising a radial locator, opposite edges, and a distal end configured to slidably engage said contoured wall along the width of said contoured wall including said plurality of lobes;

wherein said radial locator comprises a pair of balls configured to follow respective ones of said grooves to drive said vane radially inwardly and outwardly in response to rotation of said rotor;

wherein each of said balls has a diameter not exceeding a thickness of a respective one of said vanes at each of said balls; and wherein said side surfaces of said rotor casing cooperate with said opposite edges of said vane to form fluid-tight barriers, and said distal end of said vane forms a fluid-tight barrier with said contoured wall including said lobe.

8. The pump or turbine of claim 7, wherein said radial locator comprises a dimple formed in each of two opposite edges of said vane, wherein one of said balls is captured between each of said dimples and a respective one of said grooves.

9. The pump or turbine of claim 7, wherein said radial locator maintains said distal end in continuous sliding contact with said contoured wall including said lobe when said rotor is rotating.

10. The pump or turbine of claim 7, wherein said contoured wall includes exactly four of said lobes, said contoured wall defining an inlet port and an outlet port at each of said lobes, and wherein said pump or turbine comprises exactly thirteen of said vanes spaced evenly along said outer rotor surface.

11. A method of operating a positive-displacement pump or turbine, said method comprising:

rotatably driving a pump or turbine rotor located within a rotor chamber, the rotor having a rotational axis at a central axis of the rotor chamber, the rotor having a plurality of vanes mounted at respective blind slots formed in cylindrical outer rotor surface thereof, the blind slots each having a continuous slot width extending from proximate the outer rotor surface to proximate a blind inboard end, the vanes having track followers, the track followers having a thickness not exceeding a thickness of the vanes at the track followers; and urging the vanes radially inwardly and outwardly via engagement of the track followers with a curved track formed in a sidewall of the rotor chamber to maintain distal ends of the vanes in sliding engagement with a contoured wall of the rotor chamber along the width of the contoured wall, the contoured wall including a lobe;

wherein the curved track is spaced a fixed distance from the contoured wall including the lobe.

12. The method of claim 11, wherein said urging the vanes radially inwardly and outwardly comprises driving the track followers in the form of balls associated with each of the vanes along a groove that forms the curved track.

13. The method of claim 12, wherein each of the vanes defines a recessed dimple, and wherein each of the balls are captured between the groove and respective ones of the recessed dimples.

14. The method of claim 13, wherein the groove has a semi-circular cross-sectional shape and the recessed dimples each have a semi-spherical shape.

15. The method of claim 14, wherein the balls are spherical and slide or roll along the groove so that the recessed dimples maintain alignment with the groove during rotation of the rotor and the vanes.

16. The method of claim 15, wherein about one-half of each of the balls is contained within one of the recessed dimples and the other half is contained in the groove.

* * * * *